US006585585B1

(12) United States Patent
Fletcher

(10) Patent No.: US 6,585,585 B1
(45) Date of Patent: Jul. 1, 2003

(54) MATHEMATICAL PUZZLE GAME SYSTEM AND METHOD

(76) Inventor: Joel Anthony Fletcher, 2525 S. Braddock Ave., Swissvale, PA (US) 15218

( * ) Notice: Subject to any disclaimer, the term of this patent is extended or adjusted under 35 U.S.C. 154(b) by 240 days.

(21) Appl. No.: 09/671,795

(22) Filed: Sep. 28, 2000

Related U.S. Application Data

(63) Continuation-in-part of application No. 09/065,584, filed on Apr. 24, 1998, now abandoned.

(51) Int. Cl.[7] ..... A63F 13/00; A63F 3/00
(52) U.S. Cl. ..... 463/9; 273/236
(58) Field of Search ..... 463/9, 15; 434/201, 434/191, 177; 273/236, 271, 272, 237, 460, 153 R

(56) References Cited

U.S. PATENT DOCUMENTS 3,984,108 A * 10/1976 Marzo ..... 273/135 B
4,216,964 A * 8/1980 Gans ..... 273/153 R
5,156,548 A * 10/1992 Grafflage ..... 434/208
5,566,942 A * 10/1996 Elum ..... 273/153 R
5,573,245 A * 11/1996 Weiner et al. ..... 273/153 R
5,921,864 A * 7/1999 Walker et al. ..... 463/9
6,062,978 A * 5/2000 Martino et al. ..... 463/9
6,206,372 B1 * 3/2001 Harris ..... 273/153 S

OTHER PUBLICATIONS

PennyPress, Number Fill–In Puzzles, Sep. 1997.*

* cited by examiner

*Primary Examiner*—Kim Nguyen
(74) *Attorney, Agent, or Firm*—Pravel Intellectual Property Law, P.C.; James W. Pravel

(57) ABSTRACT

A digital game device and method that can be played on a game board or planar grid structure or on an electronic device are disclosed; the crossword style mathematical apparatus includes a pre-defined play area having a combination of useable and unusable empty spaces that are oriented in a horizontal and a vertical direction; the resulting grid structure forms a combination of horizontal, vertical, and diagonal rows of useable and unusable spaces; a set of rules is applied to the resulting grid structure wherein numbers are selectively entered by the player into the useable empty spaces such that the mathematical difference between adjacent numbers entered into the grid structure is greater than one; in addition, the rules specify that all individual numbers in any continuous horizontal, vertical, or diagonal direction are different.

17 Claims, 9 Drawing Sheets

Microfiche Appendix Included
(1 Microfiche, 50 Pages)

ANSWER GROUPS 120 122

| ACROSS | | | | DOWN | | | |
|---|---|---|---|---|---|---|---|
| 1A | 2A | 3A | 4A | 1D | 2D | 3D | 4D |
| .2536 | 159 | 173 | 1364 | 3925 | 57924 | 2493 | 61497 |
| | 572 | 175 | 4153 | 4853 | 58396 | 5194 | 68319 |
| | 837 | 813 | 5163 | 4936 | 59172 | 5714 | 69713 |
| | 853 | 816 | 5947 | 7152 | | 6813 | |
| | 973 | 935 | | | | | |
| 5A | 6A | 7A | 8A | 5D | 6D | 7D | 8D |
| 16928 | 36274 | 1970 | 153 | 24935 | 1397 | 25146 | 2648 |
| 19382 | 42593 | 5718 | 192 | 63524 | 5379 | 49531 | 3952 |
| 92746 | 74635 | 5917 | 913 | 95138 | 8649 | 85731 | 7168 |
| | | 9157 | 952 | | 9513 | | 9386 |
| 9A | | | 972 | | | | |
| 274 | 10A | | | | | | |
| 293 | 4861 | | | | | | |
| 384 | 4968 | | | | | | |
| 573 | 5817 | | | | | | |
| 614 | 8516 | | | | | | |

GIVEN number set

ANSWER GROUPS 120 122

| ACROSS | | | | DOWN | | | |
|---|---|---|---|---|---|---|---|
| 1A | 2A | 3A | 4A | 1D | 2D | 3D | 4D |
| .2536 | 159 | 173 | 1364 | 3925 | 57924 | 2493 | 61497 |
| | 572 | 175 | *4153 | *4853 | 58396 | 5194 | *68319 |
| | *837 | 813 | 5163 | 4936 | *59172 | *5714 | 69713 |
| | 853 | *816 | 5947 | 7152 | | 6813 | |
| | 973 | 935 | | | | | |
| 5A | 6A | 7A | 8A | 5D | 6D | 7D | 8D |
| *16928 | 36274 | 1970 | 153 | 24935 | 1397 | *25146 | 2648 |
| 19382 | *42593 | *5718 | *192 | *63524 | 5379 | 49531 | 3952 |
| 92746 | 74635 | 5917 | 913 | 95138 | *8649 | 85731 | *7168 |
| | | 9157 | 952 | | 9513 | | 9386 |
| 9A | | | 972 | | | | |
| 274 | 10A | | | | | | |
| 293 | 4861 | | | | | | |
| *384 | *4968 | | | | | | |
| 573 | 5817 | | | | | | |
| 614 | 8516 | | | | | | |

. GIVEN number set
* correct answers

MESSAGE WORD NUMBER & ENCODER LATCH NETWORK
U27
/31
/31
/63
/65
(13 hex in)
/64
/60
U28
MESSAGE WORD REGISTER
/65
FONT COUNTER & COMPARE NETWORK
/31
/61
U30
/63
/58
/58
/61
/62
U31
MESSAGE WORD SELECTOR
/62
FONT COUNTER ROM
U29
/48
U32
/48
DISP BUFF oe
/66
/66
/66
/63
U33
MESSAGE SCREEN-1
U34
MESSAGE SCREEN CONTROL
/67
/66
U35
MESSAGE SCREEN-2

MATHEMATICAL PUZZLE GAME SYSTEM AND METHOD

CROSS-REFERENCE TO RELATED APPLICATION

This is a continuation-in-part of U.S. patent application Ser. No. 09/065,584, which was filed on Apr. 24, 1998, now abandoned.

This application refers includes one (1) microfiche appendix, including the fifty (50) frames.

BACKGROUND OF THE INVENTION

The present invention relates to puzzle games. More specifically, the invention involves mathematical, crossword style puzzle games that can be played on a board or grid structure or on an electronic playing device.

A portion of the disclosure of this patent document contains material, which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Crossword puzzles are said to be the most popular and widespread word game in the world. The first known crossword puzzle was created by Arthur Wynne and was published in the New York World Newspaper on Dec. 13, 1913. It was not until 1924 that the first book of crossword puzzles was published.

Crossword style puzzles have also been created using numbers in place of letters or words. The number puzzles are typically called number fill-in puzzles because answer sets are provided from which the player selects possible solutions to the puzzle. Only one of the number answers from each answer set will fit properly in the puzzle. In number fill-in puzzles, the answer sets are organized according to the number of digits in each of the answers in the set.

What is needed is a numeric crossword style game based on a set of rules that can be played either on a board or planar grid structure or on an electronic hand held device. The printed planar grid structure can be printed in books, magazines or newspapers.

Attached, and incorporated herein, are fifty (50) frames of a microfiche appendix, which includes instruction code written in machine language, including notations.

SUMMARY OF THE INVENTION

The present invention provides a numeric game device and method that can be played on a game board or planar grid structure or on an electronic device. Preferably, the electronic device will be small enough to be held within the player's hand.

The crossword style mathematical apparatus includes a pre-defined play area having a combination of useable and unusable empty spaces that are oriented in a horizontal and a vertical direction. The resulting grid structure forms a combination of horizontal, vertical, and diagonal rows of useable and unusable spaces. A set of rules is applied to the resulting grid structure wherein numbers are selectively entered by the player into the useable empty spaces such that the mathematical difference between adjacent numbers entered into said grid structure is greater than one. In addition, the rules specify that all individual numbers in any continuous horizontal, vertical, or diagonal direction are different.

A digital crossword-style puzzle embodiment of the invention includes an instruction memory, a logic control network, an EEPROM memory unit, a data comparator, a multi-character status display, a multi-character puzzle play screen matrix, user entry keys and a puzzle cartridge unit.

The instruction memory is operative with the logic control network and the logic control network operative with the EEPROM memory unit to:

1. Receive input from the user entry keys;
2. Display answer groups from which the user may select;
3. Display status messages concerning the status of the game on the multi character status display;
4. Display numeric data resulting from the users input on the multi-character puzzle play screen matrix; and
5. Control the flow of data between the puzzle cartridge unit and the EEPROM memory unit.

The puzzle play screen matrix includes a combination of useable and unusable empty spaces that are oriented in a horizontal direction; and a combination of useable and unusable empty spaces that are oriented in a vertical direction. The useable spaces have different indicia than the unusable spaces whereby the user can distinguish between the usable and the unusable spaces.

The useable and unusable empty spaces form a grid structure having a combination of horizontal, vertical, and diagonal rows of useable and unusable spaces. Each row of the useable spaces in a continuous horizontal or vertical direction forms a clue placement position.

The puzzle cartridge unit is removable and contains data that includes multiple groups of number sets, each number set includes the same number of digits as each corresponding placement position wherein an individual number set within an answer group is selected by the player with the user entry keys to fill-in the horizontal and vertical clue placements and the quantity of answer groups is equal to the quantity of clue placements. The player can choose from different puzzle cartridge units, each containing a variety of different game data in accordance with the invention.

The comparator determines if the mathematical difference between adjacent numbers on any diagonal number string resulting from the number sets entered into the grid structure by the user is greater than one; and generates a signal that is used by the logic control unit to generate a corresponding status message on the status display.

Because the data from the game data cartridge unit is stored in a non-volatile EEPROM memory element, the contents of the EEPROM will be preserved. This allows the electronic crossword-style game to be turned off without the need to have continuous power applied to the electronic crossword style game.

A method of playing a mathematical number game on a planar grid structure embodiment is also provided which has a combination of pre-defined useable and unusable empty spaces. The useable spaces are indicated by indicia different from the unusable spaces. The grid structure forms horizontal, vertical, and diagonal rows of useable spaces. The continuous useable spaces in each horizontal and vertical direction form clue placement positions. The method comprises the steps of:

a. Selecting a number set from a provided number group;
b. Positioning the selected number set in a desired clue placement position on the grid structure;
c. Evaluating the selected number set in the desired clue placement position relative to the grid structure to ensure that the mathematical difference between any two adjacent numbers in any horizontal, vertical, and diagonal rows of useable spaces is greater than one;

d. Evaluating the selected number set relative to the entire grid structure to ensure that every two adjacent numbers in any continuous horizontal, vertical, or diagonal direction are different; and e. Repeating steps a through d until the selected number set passes each test set forth in steps c and d.

A crossword style mathematical game embodiment of the instant invention is also provided which comprises a predefined grid having a combination of useable and unusable spaces. The usable spaces are indicated by indicia different from the unusable spaces. The useable and unusable empty spaces forms a grid structure having a combination of horizontal, vertical, and diagonal rows of useable and unusable spaces. Each of the horizontal rows and each of the vertical rows of usable spaces is a designated clue placement position.

A set of across answer groups and a set of down answer groups, each answer group comprising number sets from which the player may choose, is provided for each of said clue placement positions. Each answer group comprises at least one correct answer set for each clue placement position that results in the mathematical difference between every two adjacent numbers in the grid structure becoming two or more. The inventive planar grid embodiment and method of play may also be used on the Internet.

DETAILED DESCRIPTION

Planar Grid Embodiment

According to the inventive method, there are three rules. First, bumping occurs if the mathematical difference between any two adjacent digits is less than two (i.e. 0 or 1). Bumping is not allowed in either a vertical, horizontal, or diagonal direction. Second, the method also requires that the number sets begin with any digit other than zero. Third, there can be no duplication of digits within an answer set. For example, 258 is valid but 252 is invalid.

Figure 1:
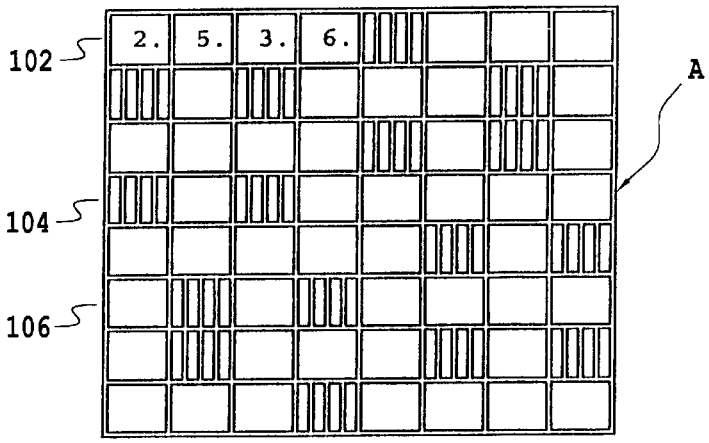
FIG. 1 is a view of the printed planar grid structure of a preferred embodiment showing an initial clue.

FIG. 1 illustrates a game board or planar grid A comprising eight squares in the horizontal direction by eight squares in the vertical direction. The planar grid structure A resembles a crossword puzzle grid in that some of the squares are useable and some of the squares are not useable. Although the grid structure shows eight squares in both the horizontal and vertical directions, it is possible to use the inventive method with a lesser or greater number of squares in each direction.

FIG. 1 illustrates an average planar grid structure having 10 Across and 8 Down clue placements. Clue placements positioned across one puzzle grid always start from the top to bottom and clue placements positioned down always start from left to right. Clue placement 1 Across will always be the first group of blank squares counting the GIVEN number set as 1 Across positioned at the top row, in the far left corner of the grid. Clue placement 2 Across will be the next group of blank squares to the right of clue placement 1. If additional clue placements are positioned across a particular row, the next clue placement will be the first group of blank squares located in the next row.

Clue placements positioned Down are found in a similar manner. Clue placement 1 Down will always be the first group of blank squares in a vertical column, starting in the top row, in the far left position on the grid. Clue placement 2 Down will be the next group of blank squares directly below clue placement 1 Down. When there are no more clue placements positioned down in the column, the next clue placement will be the first group of blank squares located at the top puzzle grid on next column.

Alternative clue placement position designations are also possible. For example, letters or numbers may be positioned outside and along the perimeter of the puzzle grid whereby the coordinate positions are provided to designate clue placement positions. As another example, small numbers can be included in the individual blank squares to be used to designate clue placement positions.

The game begins as shown in FIG. 1 with a GIVEN answer 102 in the upper left position of the grid in an across orientation. The GIVEN provides the starting clues for each puzzle and cannot be altered by the player. The placement of the GIVEN may be positioned either across or down anywhere on the puzzle grid. In a preferred embodiment, the GIVEN will intersect at least two or more clue placements that are positioned in the opposite direction from where the GIVEN is positioned. For example, in FIG. 1 the Across GIVEN provides two clues for the intersecting DOWN clue placements. The GIVEN may be highlighted or otherwise uniquely identified to distinguish it from all other number sets.

When beginning the puzzle, the player has the option of using the GIVEN to help solve the puzzle or s/he can start elsewhere on the puzzle grid. If the player decides to begin elsewhere on the grid, s/he must try to determine what number sets fit within a group without violating the bumping or the duplication rules. Although such an approach is possible, it is clearly more difficult than using the GIVEN as a starting point for solving the puzzle.

Also shown in FIG. 1 are the possible answer clues for the puzzle. The ACROSS ANSWER GROUP 120 and the DOWN ANSWER GROUP 122 are number sets that include all possible answers to the puzzle.

The number sets consist of a specific combination of three or more digits between 0 through 9. According to the method of the current invention, a valid number set must have a mathematical difference of two or more between all adjacent digits to prevent bumping. For example, 123 would be an invalid number set while 135 or 258 would be valid number sets.

All of the number sets within an answer group are listed in increasing numerical order. Answer groups typically include from 3 to 5 number sets. Choices are made from the answer groups to solve a specific clue placement on the puzzle grid. On occasion, several number sets within the same answer group include the same digits arranged in a different order to avoid violating either the bumping or duplication rules of the method. Examples of valid number sets include: 258, 582 and 825. Answer groups are listed separately and designated ACROSS and DOWN, according to the clue placement positions on the puzzle grid.

Figure 2:
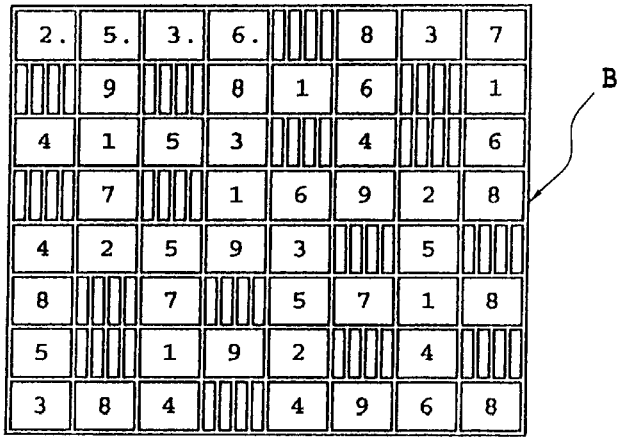
FIG. 2 is a view of the planar grid structure of a preferred embodiment showing a representative completed puzzle.

A completed planar puzzle grid B is illustrated in FIG. 2. In puzzle grid B, the solution does not violate the bumping or duplication rules in either the vertical, horizontal, or diagonal directions. Many times, it can be strategic when playing the planar grid game embodiment of the inventive method, to evaluate the diagonal number strings to be sure that they do not violate the bumping or duplication rules. If the digits within two intersecting number sets do not cause bumping or duplication of the digits in a diagonal number string, the chances are good that the selected number sets are correct. On the other hand, if there is bumping of adjacent digits, or duplication of digits in a diagonal number string, there will be an error in at least one of the puzzle answers.

It is contemplated that the inventive game may also be posted on the Internet and enabled with software, such as Java, as understood by those skilled in the art, wherein the game and method may be played by users remotely from the Internet.

Hand-Held Puzzle Computer Embodiment

The following table lists the component numbers and component descriptions of the digital crossword-style puzzle embodiment as used herein and in the drawings attached hereto.

| Element Number | Description |
|---|---|
| 10 | Portable, Hand Held Device |
| 12 | Puzzle Play Screen Matrix |
| 14 | Status Display - Upper |
| 16 | Status Display - Lower |
| | Mode Key Section: |
| 18 | Page |
| 20 | Across |
| 22 | Down |
| 24 | Puzzle |
| | Function Key Section: |
| 26 | Answer |
| 28 | Erase |
| 30 | Reset |
| 32 | Up/Down Switch |
| | Direction Key Section: |
| 36 | Up Arrow |
| 38 | Down Arrow |
| 40 | Right Arrow |
| 42 | Left Arrow |
| 44 | Power On/Off Switch |
| 34 | Numeric Key Pad |
| 46 | Puzzle Cartridge Compartment |
| 48 | Puzzle Cartridge |

Overall Operation of Hand-Held Computer Device

Figure 3:
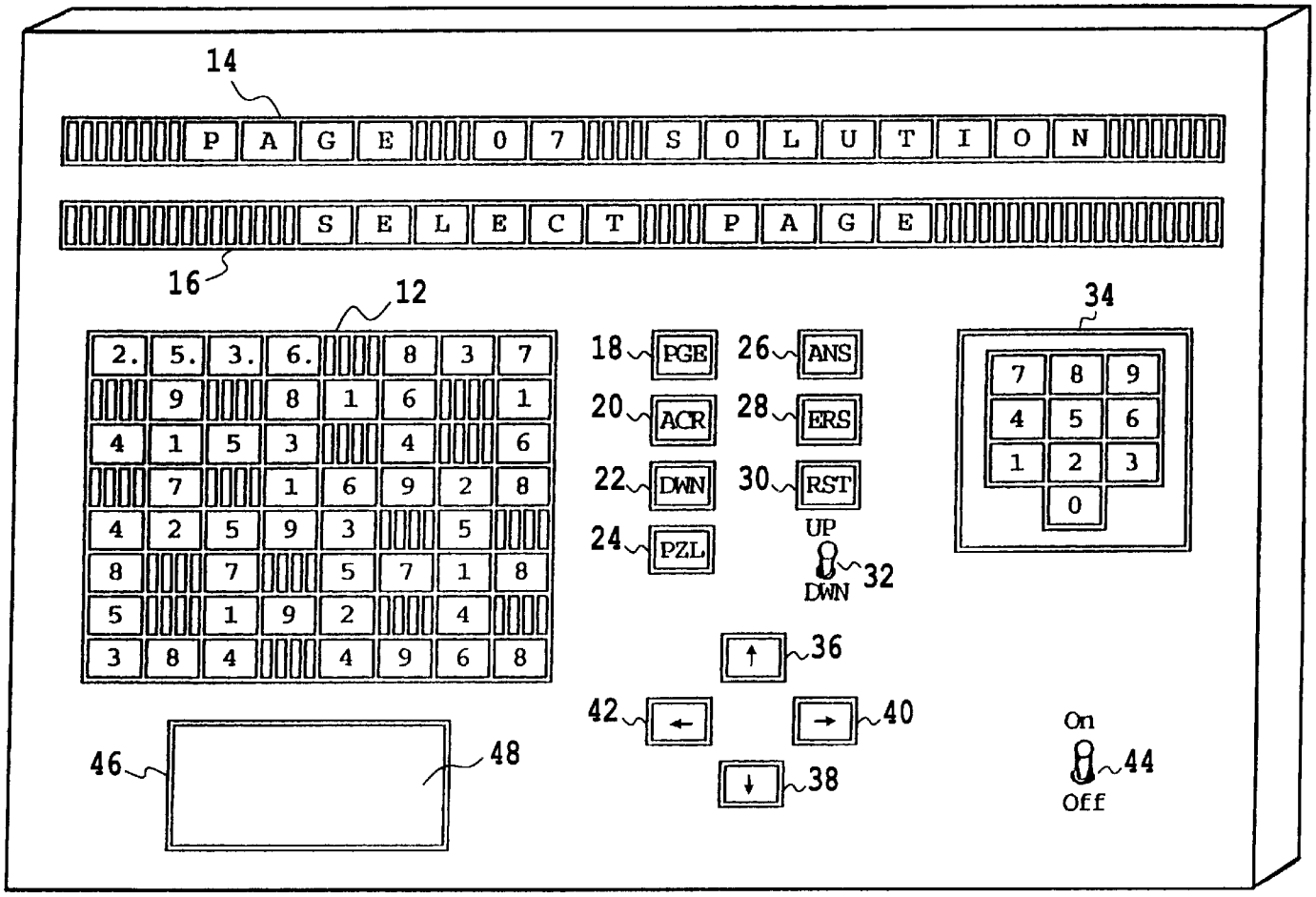
FIG. 3 is a top view of a digital, electronic embodiment of the invention.

Refer now to FIG. 3 wherein an isometric view of the digital crossword-style puzzle embodiment of the invention is shown. The portable, hand-held device 10 comprises: a puzzle play screen matrix 12, an upper status display 14, a lower status display 16, a mode key section, a function key section, an Up/Down switch 32, a direction key section, a power on/off switch 44 and a numeric keypad 34.

The upper status display 14 and lower status display 16 are used to view the displayed puzzle clues, answers and message prompts for the operator. The upper and lower status displays are typically constructed of intelligent character liquid crystal display modules.

The mode selection section includes four mode keys. The page key 18 is used to enable the page mode to provide puzzle page selections. The across key 20 is used to enable the play across mode to provide clues and answers to be displayed across. The down key 22 is used to enable the play down mode to provide clues and answers to be displayed down. The clues and answers are displayed on the lower status display 16. The puzzle key 24 used to enter the format mode of operation which enables the operator to select a puzzle page solution, or to erase a puzzle to start over. The format mode of operation will be discussed herein below.

The function key section includes four function keys: the answer key 26, the erase key 28, the reset key 30 and the up/down switch 32. When the hand-held device is in the across or down mode and the answer key 26 is pressed, the clue and answer number are displayed on the upper status display 14 together with the corresponding answer on the lower status display 16. If the hand-held device is in the page mode of operation and the answer key 26 is pressed, a single answer response is displayed on the lower status display 16 which indicates whether the puzzle is correct, incorrect, or incomplete. Simultaneously, the puzzle page number is displayed on the upper status display 14.

A single character is erased each time the erase key 28 is pressed. As each character is erased, the cursor automatically advances across or down as provided in the software instructions described in the appendix.

When the hand-held device is in the page mode of operation, pressing the reset key 30 returns control to the beginning page (home page). If the reset key 30 is pressed when the device is in the across or down modes of operation, the cursor returns to the first available clue position corresponding to the across or down mode that is currently selected. Simultaneously, the corresponding possible answers and the current clue number are displayed on the upper and lower status displays 14,16. If the reset key 30 is pressed when the device is in the puzzle mode of operation, the current puzzle is erased completely from the play screen 12 and the starting puzzle clue ("GIVEN") is displayed on the puzzle play screen 12.

When the hand-held device is in the puzzle format mode of operation, pressing the answer key 26 causes the solution page to be displayed on the play screen 12. Simultaneously, the puzzle page number is displayed on the top status display 14 and the message prompt, "select page" is displayed on the lower status display 16 (Refer to FIG. 5*g*).

The up/down switch 32 uses a single-pole double-throw toggle switch that is used together with the page key 18. If the device is in the page mode of operation and the up/down switch 32 is toggled upward, the puzzle pages are incremented sequentially beginning with page zero (the home page) to the maximum pages that are programmed within the currently installed puzzle cartridge 48. Similarly, when the up/down switch 32 is toggled downward, the puzzle pages are incremented in a reverse direction. The device has the capability to roll past page one (the home page) starting over at the beginning and providing a complete loop in a puzzle pages without requiring the user to change between the incrementing or the decrementing operation.

The numeric keypad 34 includes a separate key for each digit 0 through 9. The numeric keypad 34 is used together with the mode keys. If used with the page key 18, random puzzle pages can be selected. If used with the across key 20 or the down key 22, the numeric keypad 34 is used to make entries that appear on the puzzle play screen 12. After a key on the numeric keypad 34 is pressed, the cursor advances to the next position on the play screen 12.

The direction key section includes four direction keys: Up Arrow key 36, Down Arrow key 38, Right Arrow key 40 and Left Arrow key 42. The direction keys are used after entering the across or down modes of operation. The direction keys are used to index the blinking cursor on the puzzle play screen 12 to the next clue position moving in the direction indicated on the respective direction key.

Before the direction keys may be used, the play mode must be entered by pressing either the across key 20 or the down key 22. Once the play mode has been entered, the direction keys may be used independently of either the across or down modes. For example, if the across key 20 is pressed the device will enter the across play mode. Simultaneously, the clue corresponding to the position of the cursor on the puzzle play screen 12 will be displayed on the lower status display 16 and the current clue number together with the selected mode will be displayed on the upper status display 14. If the Down Arrow key 38 is then pressed, it will cause the device to change to the down mode automatically through the control circuitry and programmed software as described in the appendix. Thereafter, a set of all possible down answers and the corresponding clue number together with the current operating mode will be displayed on the upper and lower status displays 14,16. The information displayed will correspond to the current position of the cursor. The cursor will provide a helpful indication for the operator to know where on the play screen the clues are located.

If the Left Arrow key 42 is then pressed, the device will change back to the across mode and will perform as previously described in the across mode of operation. If either the page key or the puzzle key 24 are pressed, the device will be taken out of the play mode and the direction keys 36,38,40, 42 will be disabled.

The direction keys are used to position the cursor on the puzzle play screen 12 in the direction indicated on each direction key. Movement of the cursor with the direction keys does not alter any numeric or other data in the puzzle program. Each time the direction key is pressed the blinking cursor will advance one position. If the cursor is positioned on an existing character, the character may be changed to the new character by pressing the desired character on the numeric keypad 34. Loop around capabilities are also built-in and the movement of the cursor is continuous from the top around to the bottom when moving into a down direction and around each of the sides when moving in a side to side direction.

The power on/off switch 44 is used to provide power to the device. When the power on/off switch 44 is moved to the "on" position voltage is allowed to travel from the power source to connect the system to a ground connection thereby turning on all electrical components wired within the device. When the power on/off switch 44 is moved to the "off" position, all voltage is removed and the device is turned off.

An EPROM Puzzle Cartridge Compartment 46 is used to house the pop-in, pop-out puzzle cartridge 48. If desired, a cover may be placed over the EPROM puzzle cartridge compartment 46.

Description of Play

Refer now to FIGS. 3, 4*a*–4*f* and 5*a*–5*g*. FIG. 3 illustrates the hand-held device that has been described previously. FIGS. 4*a*–4*f* illustrate example puzzle play screens as they may appear during various stages of advancement as the puzzle is being completed by the operator. FIGS. 5*a*–5*g* illustrate example status displays which display message prompt information thereon. The information displayed in FIGS. 4*a*–4*f* corresponds to the information displayed in FIGS. 5*a*–5*g* and will be used for illustrative purposes to describe the way in which the hand-held puzzle game embodiment of the invention is played.

Figure 4A:
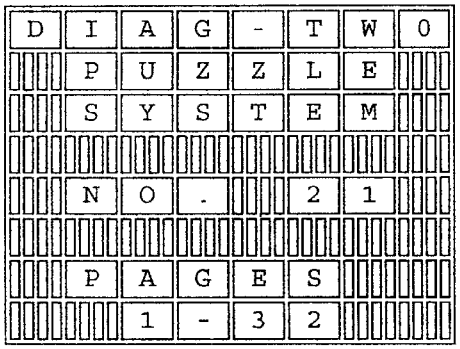
FIGS. 4*a*–4*f* show possible messages and solutions displayed on the play screen matrix.
Figure 5A:
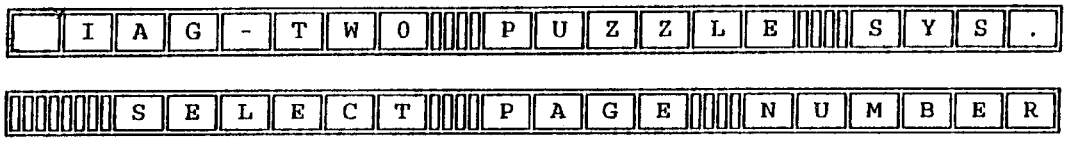
FIGS. 5*a*–5*g* show possible message prompts displayed on the message display screens.

To begin play, the user first applies power to the device by moving the power on/off switch 44 from the OFF to the ON position. The device initially displays the home page puzzle screen as illustrated in FIG. 4*a* together with the message display prompts as it illustrated in FIG. 5*a*. The home page screen displays the unalterable manufactured data such as for example, a table of contents for a particular puzzle cartridge 48. The display in FIG. 5*a* shows the name of the machine apparatus (i.e. DIAG-2 PUZZLE SYS.) and a prompt message alerting the operator to select a puzzle page number. The operator may then select a specific puzzle page number by entering the page number in the numeric keypad 34 or may select puzzle pages sequentially by using the up/down switch 32. For example, if the operator selected puzzle page 7 either directly with the numeric keypad 34 or sequentially by using the up/down switch 32, the display shown in FIG. 5*b* would appear on the upper and lower status displays 14,16.

Figure 4B:
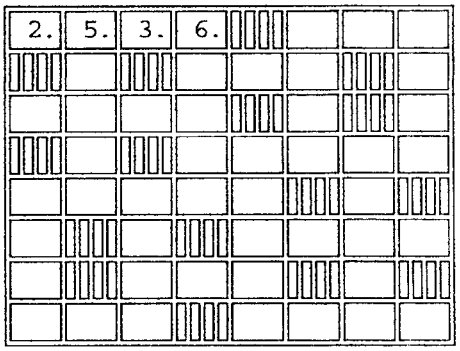
Figure 4C:
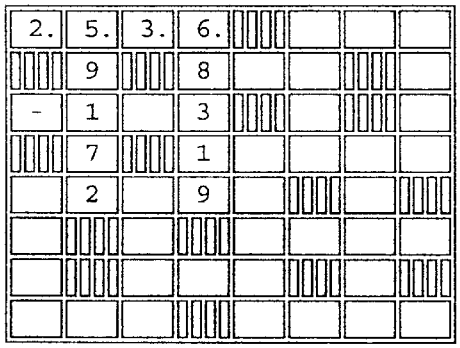
Figure 4D:
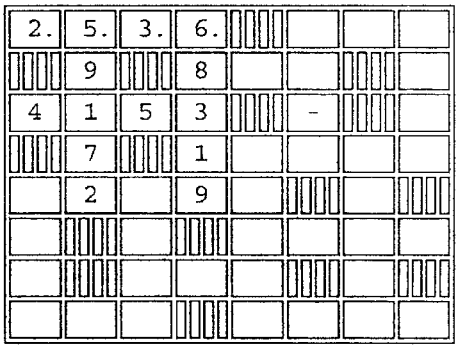
Figure 4E:
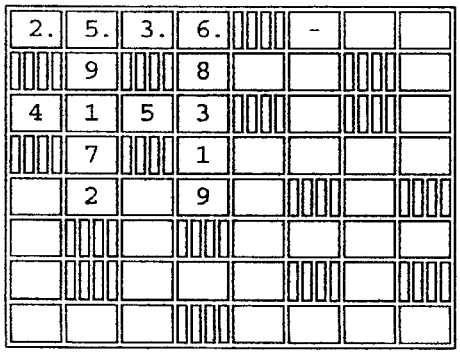
Figure 4F:
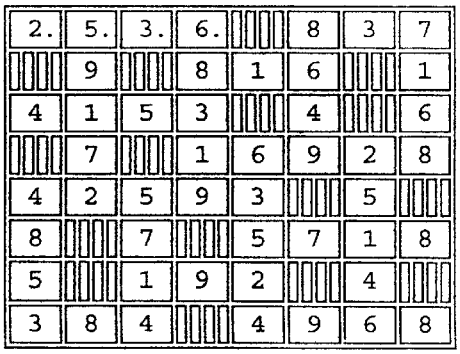
Figure 5B:
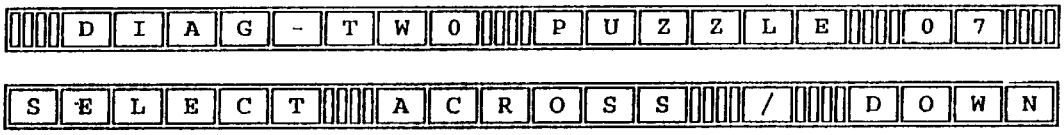
Figure 5C:
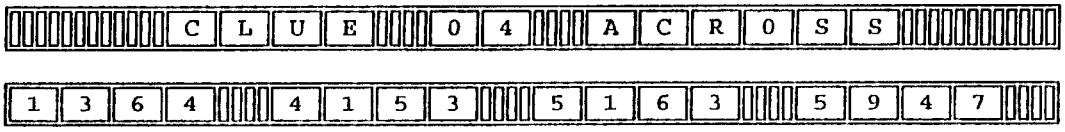
Figure 5D:
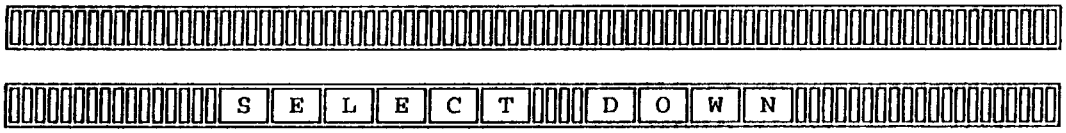

FIG. 4*b* shows an example of a single starting clue. FIG. 5*b* shows the puzzle page number on the upper status display 14 and instructions to the operator to select either across or down mode in the lower status display 16. FIG. 4*c* shows the cursor symbol (-) in the four across position. FIG. 5*c* shows the display corresponding to FIG. 4*c*. The identification of the clue number is displayed on the upper status display 14 and the possible clues for four across are shown on the lower status display 16. The clues that are shown in the lower status display 16 of FIG. 5*c* are available for the operator to choose from to use in clue position four across shown on FIG. 4*c*. The operator may enter the selected answer choice from the clues available by using the numeric keypad 34. FIG. 4*d* illustrates the appearance of the puzzle play screen 12 after the operator has entered the answer choice "4153" into the four across position. After the 3 digit has been entered as shown in FIG. 4*d*, the cursor advances past the unusable space to the next available usable space in the across direction. The resulting display on the lower status display 16 is shown in FIG. 5*d*. The message in FIG. 5*d* instructs the operator to select the down mode so that all possible clues for position six down will be displayed. After the operator presses the down key 38, the cursor automatically advances to the first space of the top of the selected row. In FIG. 4*e* the cursor is shown at the first space of the top of answer row six down. The upper and lower status displays 14,16 will then display messages similar to that shown in FIG. 5*c*, but the clues specified will be for position six down.

Figure 5E:
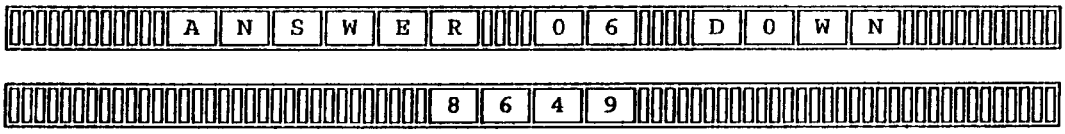
Figure 5F:
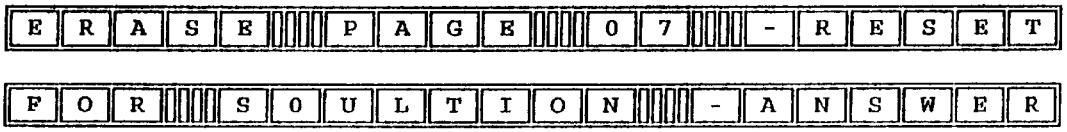
Figure 5G:
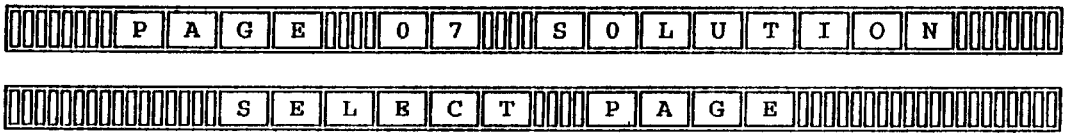

If the operator feels stumped and wants to know the correct answer for the corresponding position of the cursor, s/he can press the answer key 26 to display the correct answer. For example, the correct answer for six down is shown in FIG. 5*e* together with the current mode.

Figure 6A:
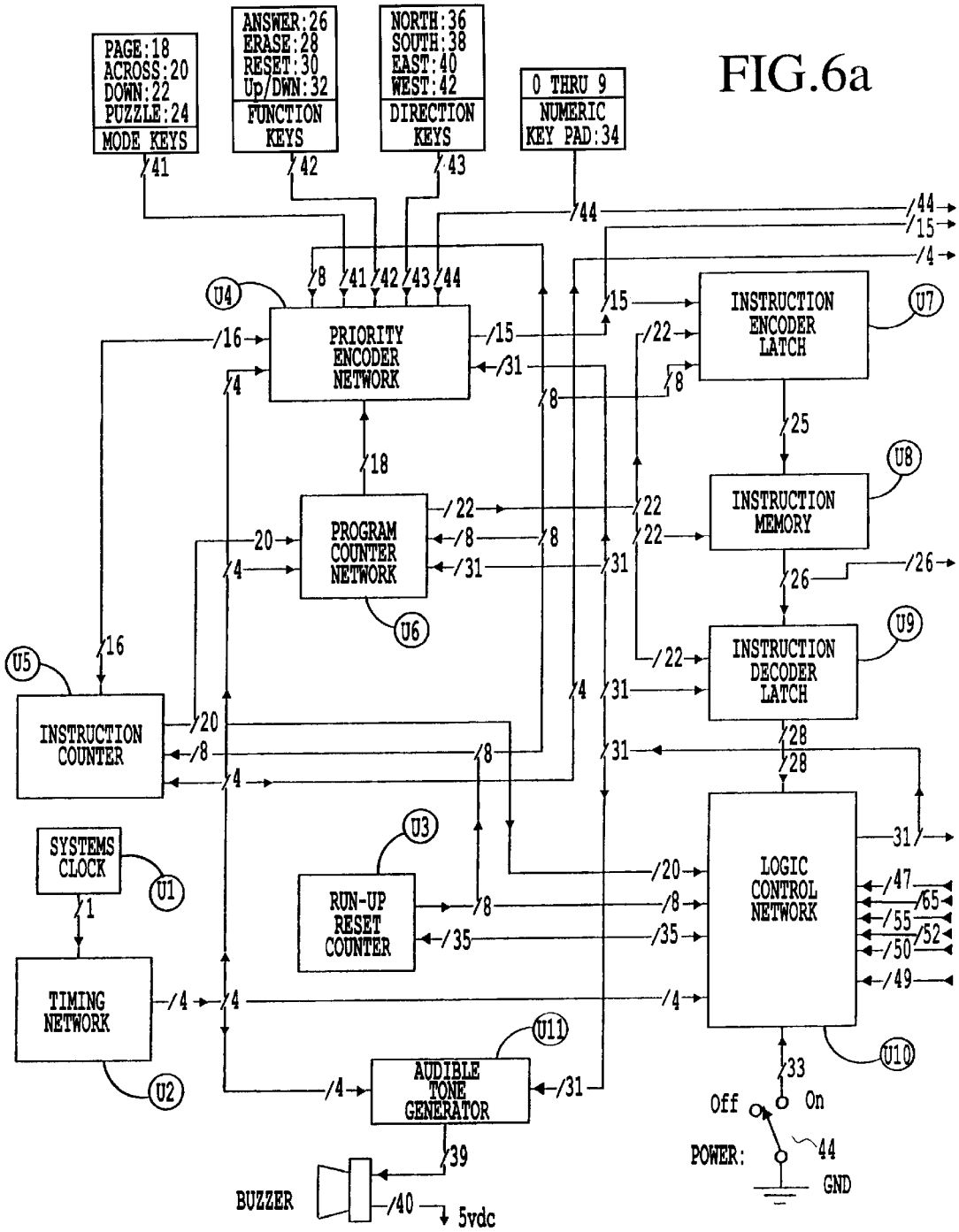
FIGS. 6*a*–6*d* illustrate the network schematic drawing of the circuit of a preferred embodiment of the present invention.
Figure 6B:
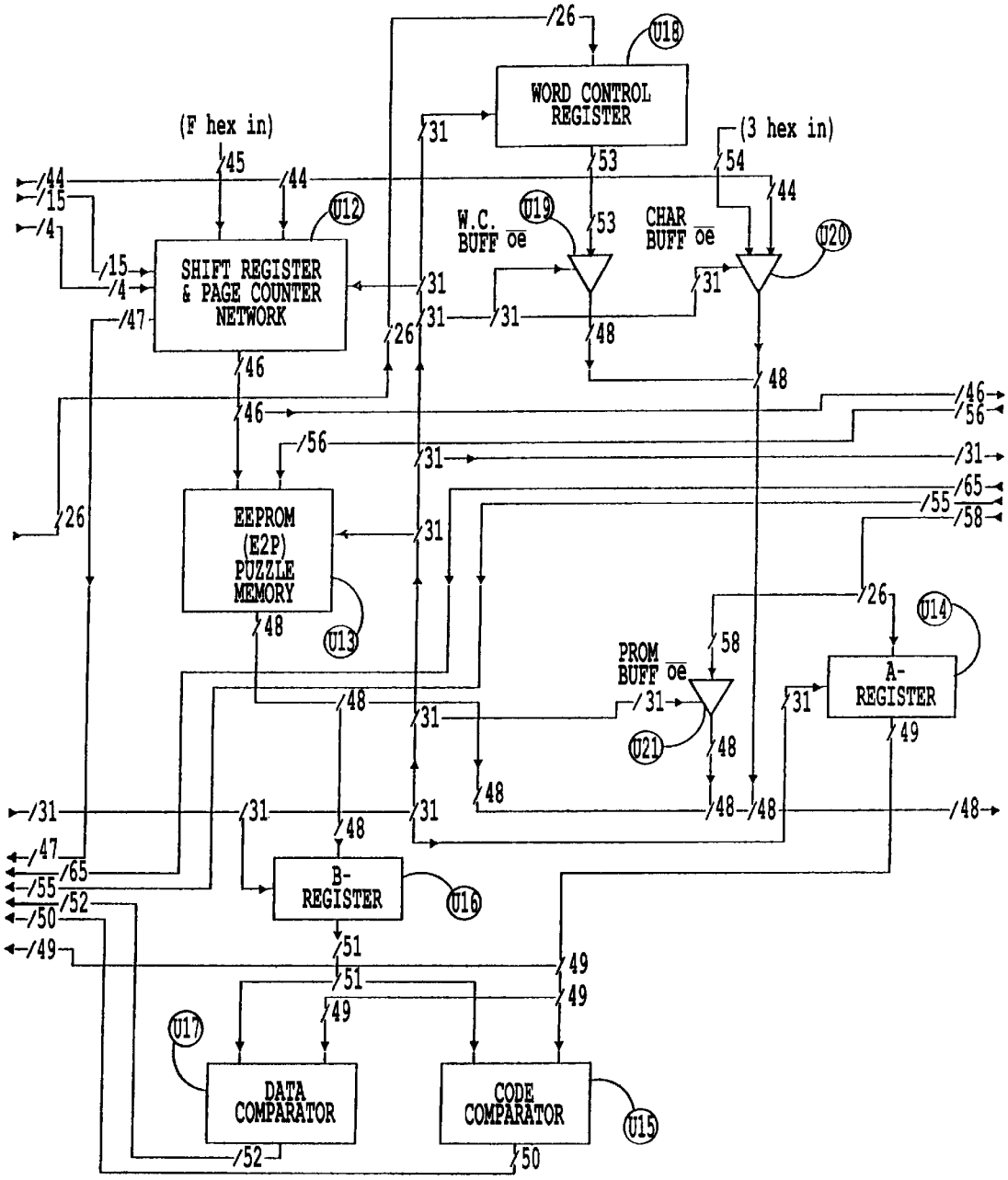
Figure 6C:
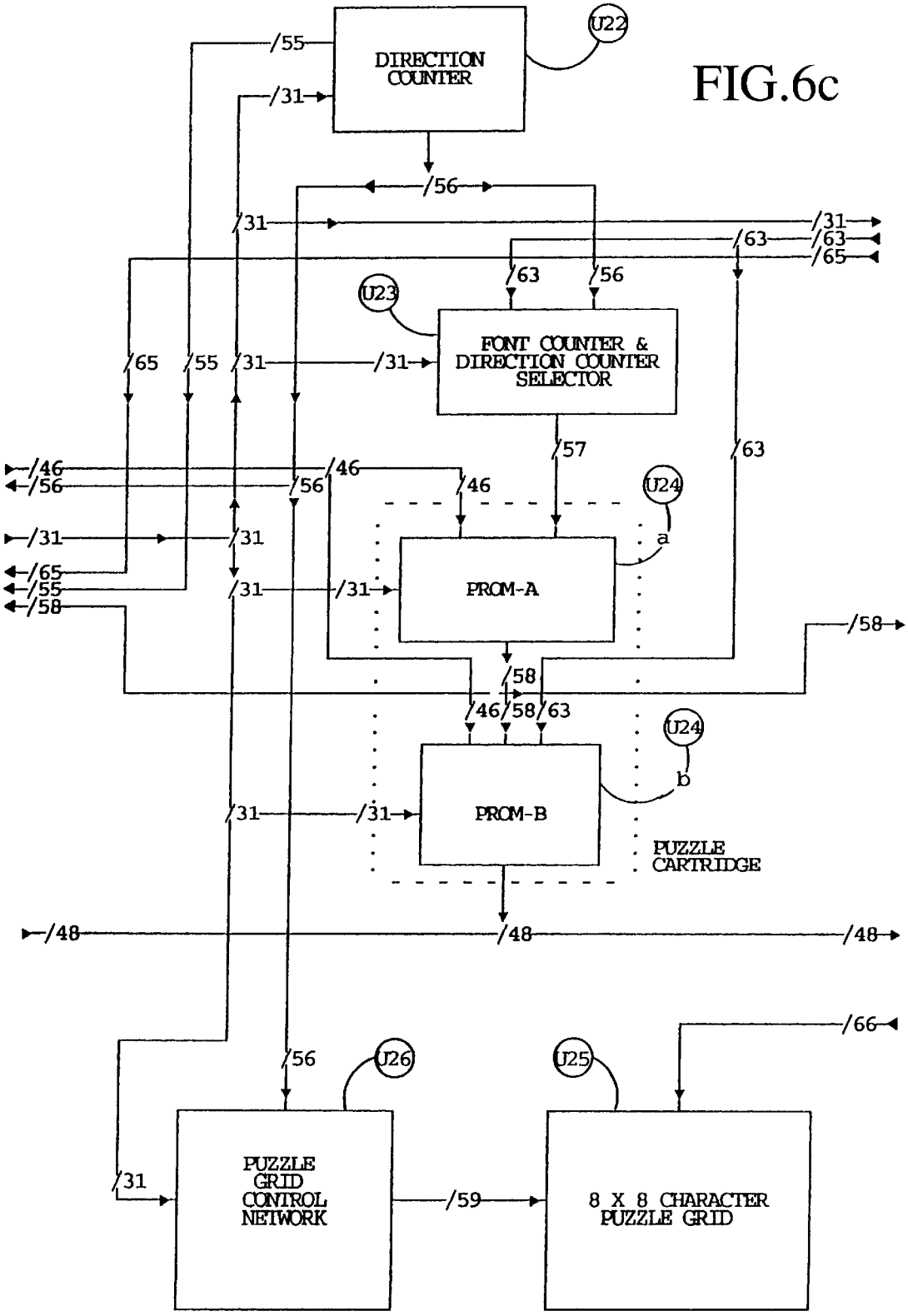
Figure 6D:
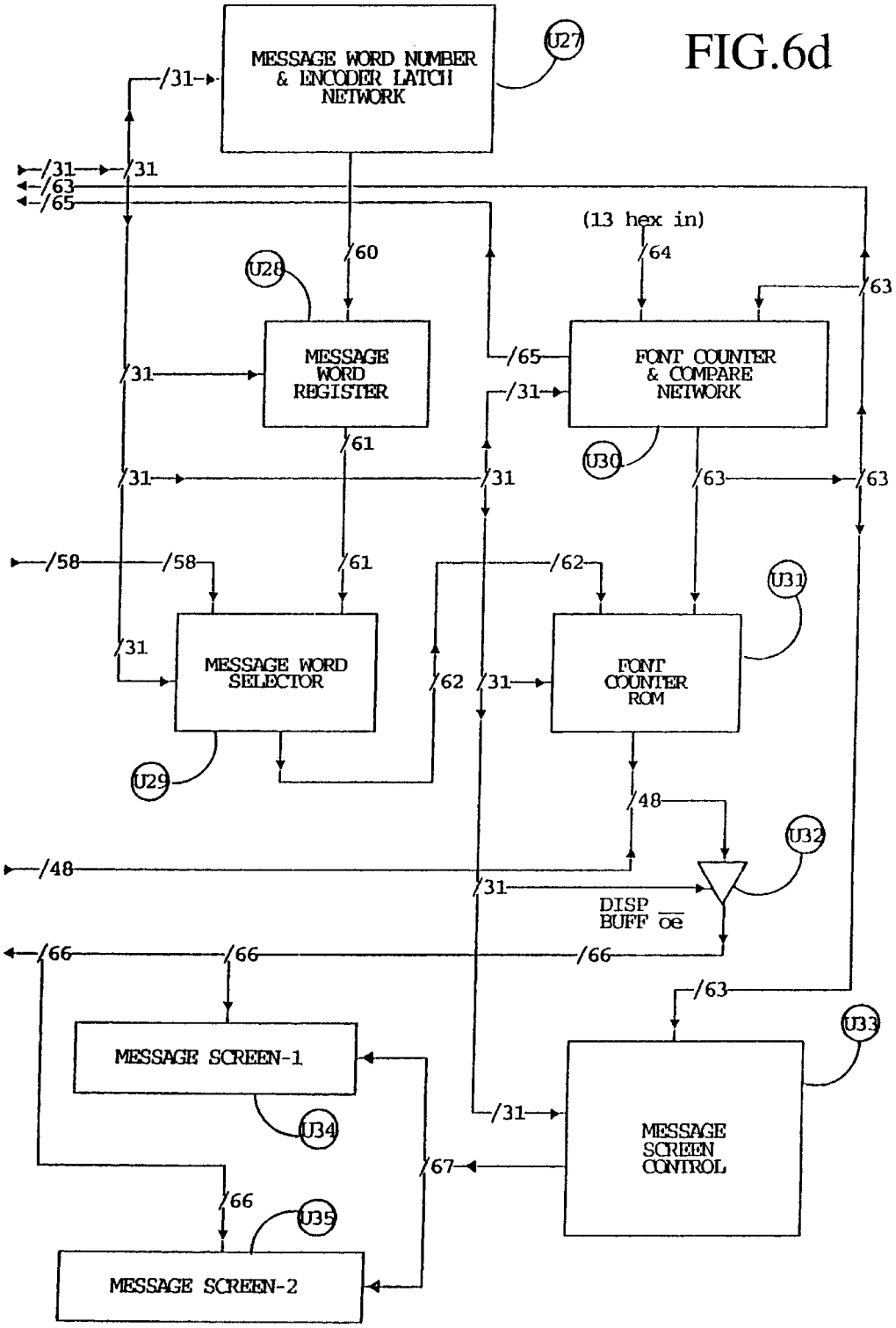

The operator has the option to view the entire puzzle page solution or to erase the puzzle currently being displayed at any time during play. To do so, the operator must first press the puzzle key 24 to cause the device to enter the format mode of operation. A prompt will then appear on the upper status display 14 indicating that the operator should press the reset key 30. Once the reset key 30 has been pressed, the puzzle is instantly erased from the EEPROM memory unit U13 (FIG. 6*b*) while the puzzle continues to be displayed on the puzzle play screen 12. The upper status display 14 then displays a message prompt, for example "PUZZLE 7 ERASED." The lower status display 16 simultaneously displays a message prompt, "SELECT PAGE."

If the operator decides to return the puzzle to its original state, he or she can by pressing the page key 18, followed by pressing the reset key 30 (See FIG. 4*b*). The operator can press the answer key 26 any time before pressing the reset key 30. This will cause the hand held device 10 to display the entire puzzle solution as described above. Each time the puzzle key 24 is pressed, the upper status display 14 displays a prompt. For example, "TO ERASE-RESET" may be displayed on the upper status display 14. Simultaneously, a prompt is displayed on the lower status display 16. For example, "SOLUTION-ANSWER" may be displayed on the lower status display 16. These prompts give the operator an indication of the options that are available to choose from.

Description of the Schematic Drawings

The schematic drawings of a preferred embodiment of the invention are shown in FIGS. 6*a*–6*d*. The schematic drawings illustrate interconnected electronic components which provide a system for generating electronic numeric puzzles and solutions. The system utilizes a replaceable puzzle cartridge U24,48. The assembly language instructions for the device are included in the appendix, which is hereby incorporated by reference.

When the power on/off switch 44 is moved from the "OFF" to the "ON" position, electrical connection from the device to ground is made and power is then applied to all of the logic block networks of the device described herein.

At the beginning of the operation, the system clock U1 begins to generate a continuous clock signal that provides synchronization for the device. The clock signal is output via line /1 over the timing network U2. The timing network U2 develops the timing signals by dividing the clock input via /1 into separate frequencies from the original clock input. To synchronize the system components, the timing signals are output via /4 over the priority encoder network U4, the instruction counter U5, the program counter U6, the logic control network U10, the audible tone generator U11, and the shift register and page counter network U12.

At the same instant the timing signals are sent, the logic control network U10 sends out a start signal via /35 to the run-up reset counter U3 which causes a reset pulse to be sent via /8 to the instruction counter U5, the program counter U6, the instruction encoder latch U7, and the logic control network U10. The logic control network U10 is also used to send a start signal that is input at the priority encoder network U4 where the signal is encoded to provide the second-half of the address for the run-up instruction program stored as the starting address within the instruction memory U8 where the signal is used to initiate to reset of all system components. The logic control network U10 then sends a signal back to the run-up reset counter via /35 which disables any further reset operations.

Before the run-up instruction program begins, the priority encoder network U4 first sends out the starting address via /15 to the instruction encoder latch U7 where the address is latched to and held as the first half of the input address for the instruction memory U8 via /25. A signal is then sent from the priority encoder network U4 via /16 to signal the instruction counter U5 that a program instruction has been received and to enable the program counter network U6 for incrementing operations. Another signal is then sent from the instruction counter U5 back to the priority encoder network U4 via /16 to de-bounce the program instruction input thus ensuring that only one input pulse is received.

The program counter U6 then sends a signal via /18 to the priority encoder network U4 where it disables any further inputs to the priority encoder network U4. The program counter network U6 provides the second-half of the address input to the instruction memory via /22. As the program counter is incremented by the logic control network U10 via /31, the address input to the instruction memory U8 changes to the next count address via /22. The instruction counter U5 then sends a signal via /20 to the program counter U6 which causes of the program counter U6 to start counting. The program counter U6 then sends a signal to the instruction encoder latch U7 via /22 which latches the input address /15 to the instruction memory U8 via /25. The program counter U6 also sends a read signal to the instruction memory U8 which causes the instruction memory U8 to read the instruction input address together with the program counter's U6 count address to the instruction decoder latch U9 and to the word control register U18.

The program counter U6 then sends a signal to the instruction decoder latch U9 that latches the instruction address input /26 to the logic control network U10 via /28. The instruction counter U5 then sends a signal to the control logic network U10 via /20 which causes the control logic network U10 to fire the correct active transition signal over the appropriate component networks via the control bus /31. The selected block network is thereby turned on or off, as directed by the software instructions that are programmed within the instruction memory U8.

The program counter U6 is then checked within the logic control network U10 to determine whether the circuit has been set. If the instruction which is used as the code word to stop the program counter U6 has not been received via the control bus /31, the program counter U6 will then be incremented to the next instruction address. If the stop latch has been set as the result of the arrival of the stop instruction, the program counter U6 will then be reset and all operations will stop. If the program counter U6 is reset as a result of a signal sent by the control logic network U10 via the control bus /31, the program counter U6 will send a signal to the priority encoder network U4 via /18. This will enable all mode, function, direction and numeric key inputs via /8, /41, /42, /43 and /44 to begin the next instruction.

A no operation pulse is used for delay. It is placed as the first instruction in the run-up program according to the run-up instructions as provided in the appendix. Each time the program counter U6 is incremented to the next instruction, the process to fire the next instruction as just described is repeated with the program counter U6 starting at the next count position. As the program counter U6 counts through the run-up instruction address, a jump is made to the next instruction routine and the program will operate until a stop signal is detected at the control logic network U10 via /28.

The hand held device 10 includes four memory components: the EPROM puzzle cartridge pair U24*a* and U24*b*, the instruction memory U8, the EEPROM puzzle memory U13 and the font counter ROM memory unit U31.

The EPROM puzzle cartridge pair U24*a* and U24*b* store and provide the puzzle character data that is scrolled onto the upper status display 14 and play screen 12. The top half of the PROM puzzle cartridge pair U24*a* stores the puzzle character data including the home page, solution page, puzzle page numbers and puzzle cartridge format code numbers. The bottom half of the PROM puzzle cartridge pair U24*b* stores all puzzle clues and answer data for each puzzle page.

The instruction memory U8 is a PROM device that is used in the handheld device 10 as a ROM processor element to provide the operational control for all of the system's network components. It is programmed to include the machine software instructions that are listed in the appendix. The passing of data through each network component connected to the data bus /48 is driven under the control of the system's software instructions that are stored within the instruction memory U8 and through the logic control network U10 via the control bus /31.

The EEPROM puzzle memory U13 is a non-volatile RAM device that is typically hard wired within the hand held device 10. It is used as a "scratch pad" or temporary memory element to store the operator's numeric key input data that is played onto the puzzle play screen 12 in the across and down modes of operation. Data is written to the EEPROM puzzle memory U13 by the operator when solving the puzzle and by machine processing when formatting the system. It is also used to store the puzzle number code after power is first applied to the device. The number code is transferred into the EEPROM puzzle memory U13 via the data bus /48 from the PROM puzzle cartridge memory U24 for comparison purposes.

The puzzle codes of each memory element are compared against each other by the code comparator U15. The PROM puzzle cartridge U24 code number is transferred to the comparator U15 via /49 and the EEPROM puzzle memory U13 is transferred to the comparator U15 via /51 from the B-Register onto the data bus via /48. The code comparator U15 determines whether the two puzzle codes match and sends a signal via /50 to the logic control network U10. The logic control network U10 uses the signal to identify the particular puzzle cartridge and to determine if a format operation needs to be performed on the EEPROM puzzle memory U13. If a format operation is required, a jump is made to the PROM-FORMAT instruction and the operation is performed as identified in the appendix.

The font counter ROM U31 is used to store the data for all message word prompts that are displayed on the upper and lower message display screens 14,16. In the across or down modes of operation, the PROM puzzle cartridge U24*a* generates clue and answer numbers to the message word selector U29 via /58. The message word selector U29 passes the clue or answer numbers to the font counter ROM U31 via /62. The font counter ROM U31 output to the data bus /48 is driven by the output address from the font counter and compare network U30 via /63 and from the message word selector U29 via /62. The font counter ROM U31 then generates a message word prompt, e.g. "CLUE 6 DOWN" onto the data bus /48.

Whenever a mode key is selected via /41, a function key is selected via /42, a direction key is selected via /43, or a numeric key input is selected via /44, the corresponding signal is sent to the priority encoder network U4 where the key input is encoded. The priority encoder network U4 then sends the encoded signal out as the starting instruction address via /15 to the instruction encoder latch U7 and to the shift register and page counter network U12. A signal is then sent from the priority encoder network U4 via /16 that is used to signal the instruction counter U5 that a program instruction has been received. The signal then enables the program counter network U6 for incrementing operations.

Another signal is sent from the instruction counter U5 back to the priority encoder U4 via /16 to de-bounce the program instruction input to ensure that only one input pulse is received. The program counter network U6 then sends a signal via /18 to the priority encoder network U4 where it disables any further input to the priority encoder network U4.

The program counter network U6 provides the second half of the address input to the instruction memory U8 via /22. As the program counter network U6 is incremented by the logic control network U10 via the control bus /31, the address input via /22 to the instruction memory U8 changes to the next count address. The instruction counter U5 then sends a signal via /20 to the program counter U6 which causes the program counter U6 to start counting. The program counter U6 then sends a signal to the instruction encoder latch U7 via /22 which latches the address input /15 to the instruction memory U8 via /25. A read signal is also sent from the program counter U6 to the instruction memory U8 which causes the instruction memory U8 to read the instruction input address together with the count address of the program counter U6. The read signal is sent to the instruction decoder latch U9 and to the word control register U18 via /26. The program counter U6 then sends a signal to the instruction decoder latch U9 that latches the instruction address input /26 to the Logic Control Network U10 via /28. The instruction counter U5 then sends a signal to the control logic network U10 via /20 which causes the control logic network U10 to fire the correct active transition signal to the appropriate network component via the control bus /31.

As the operator enters the numeric data from the numeric key pad, the characters are written in the EEPROM Puzzle Memory U13 at the address location corresponding to the position of the cursor on the play screen 12 moving in the across or down direction. A 4-bit number from the numeric key pad 34 is entered by the operator via /44 and is placed as the least significant input that is combined with a fixed 3 hex number input in the most significant address position of the character output buffer U20 via /54. The combination of the fixed 3 hex number via /54 and the numeric key input by the operator via /44 forms the ASCII code number needed to create the numeric digits 0 through 9. The numeric digits 0 through 9 are read from the character output buffer U20 after the control signal is received via the control bus /31. The character output buffer U20 then reads the numeric character data into the data bus /48 to be displayed onto the play screen 12.

A fixed page number input to the shift register and page counter network U12 is provided via /45 (F hex=16 pages). The fixed page number input is used for comparison with the numeric key input entered by the operator from the numeric key pad 34 via /44.

When the operator enters a page number selection into the hand held device 10 that exceeds the fixed number input, a greater than page number output signal is generated and sent from the shift register and page counter network U12 via /47 to the logic control network U10. This causes a reset signal to be sent from the logic control network U10 to the shift register and page counter network U12 via /31. This resets the shift register and page counter network U12 address output to the zero page and out via /46. The zero page number address is then sent from the shift register and page counter network U12 via /46 to the EEPROM puzzle memory U13 and to the EPROM puzzle cartridge U24*a*, U24*b*, where it provides the most significant address to both memory elements.

The direction counter U22 is used to provide the second half of the address to the EEPROM puzzle memory U13 via /56 and the second half of the address input for the font counter and direction counter selector U23. The direction counter U22 provides a selected output through the font counter and direction counter selector U23 via /57 to the second half of the address for the EPROM puzzle cartridge U24*a*. It is also used to provide the input address to the puzzle grid control network U26 via /56 to control the read/write operation of the puzzle play screen 12 via /59. The EEPROM puzzle memory U13 and the PROM puzzle cartridge U24 hold the same page number address via /46 from the shift register and page counter network U12 and the direction counter address from the direction counter U22 via /56.

The direction counter U22 is divided into two separate counting elements within the direction counter network U22. One counter is described as the N-S direction counter that controls the north and south directional movement of the cursor and is driven by the up and down direction arrow keys 36,38. The E-W direction counter is driven by the right and left direction arrow keys 40,42 and is used to control the east-west direction movement of the cursor.

The message word number and encoder latch network U27 is used to store the encoded message word numbers 0 through 15. The encoded message word numbers represent a particular message prompt to be displayed on the upper and lower status displays 14,16. Each encoded number in the circuit can be expressed as a digital representation of the hexadecimal digits 0 through F and is used as the input signal to the message word register U28 via /60. The message word register U28 latches the encoded number input and passes it to the least significant address input side of the message word selector U29 via /61.

The output of the message word selector U29 is then passed to the most significant address input side of the font counter ROM U31 via /62. The message word number that is output from the message word selector U29 via /62 determines which message prompt should be scrolled and displayed from the font counter ROM U31 on the upper and lower status displays 14,16. The message prompts associated with the message word number to be scrolled onto the status displays 14,16 are listed in the following table.

| FONT COUNTER ROM NUMBER MESSAGE PROMPTS: | |
|---|---|
| WORD 0 | NOT USED |
| WORD 1 | NOT USED |
| WORD 2 | PUZZLES ARE READY |
| WORD 3 | CREATING PUZZLES |
| WORD 4 | PUZZLE INCORRECT |
| WORD 5 | PUZZLE INCOMPLETE |
| WORD 6 | PLEASE WAIT! |
| WORD 7 | SELECT ACROSS/DOWN |
| WORD 8 | PUZZLE ERASED |
| WORD 9 | SELECT DOWN |
| WORD A | NOT USED |
| WORD B | SELECT ACROSS |
| WORD C | FOR SOLUTION-ANSWER |
| WORD D | NOT USED |
| WORD E | SELECT PAGE NUMBER |
| WORD F | SELECT PAGE |

The word control register U18 is used in the system to temporarily store the blinking and blank display attribute data used by the hand held device 10. The attribute data is then used to control the blinking and blanking of the status displays 14,16 and the blinking of the cursor alternating with the numeric character at the cursors position on the puzzle play screen 12. The attribute data is output from the word control register U18 via /53 to the word control output buffer U19 and passed to the data bus /48 when a read signal from the logic control network U10 is sent to the control bus input via /31.

During the across and down playing modes the clue and answer numbers are produced from the PROM puzzle cartridge U24*a* and sent via /58 to be used as the most significant word number address to the message word selector U29. During the page selection or puzzle formatting operations a read signal is sent from the logic control network U10 via /31 that reads the data from the PROM Puzzle Cartridge U24*a* to the PROM output buffer unit U21, the A-Register U14, and to the b-unit within the PROM puzzle cartridge U24*a* via /58.

The A-register U14 is used to store the puzzle cartridge character data and the cursor movement status flags to be read and compared at the code comparator U15, data comparator U17, and the logic control network U10 via /49. The PROM output buffer U21 is used to pass the puzzle cartridge output data via /58 to the data bus /48. The data bus /48 connects the outputs of the word control output buffer U19, the character output buffer U20, the EEPROM puzzle memory U13, the PROM output buffer U21, the EPROM puzzle cartridge U24*b* and the font counter ROM U31. The data bus /48 is also used as an input data bus line to the B-register U16 and the display output buffer U32.

Data on the data bus is passed through the display output buffer U32 via /48 to the display bus to the upper status display 14 via /66 and to the lower status display 16 and the puzzle play screen 12. The B-register U16 is used as a temporary register to store the operator's character input generated from the EEPROM puzzle memory U13 via the data bus /48. The character data output and puzzle cartridge code numbers generated from the EEPROM puzzle memory U13 through the B-register U16 are compared at the data comparator U17 and code comparator U15 via /51 against the puzzle cartridge character and code data output generated through the A-register U14 via /49. The result of the comparison is output from the data comparator U17 via /52 and code comparator U15 to the logic control network U10 via /50.

The font counter and compare network U30 are used as the character font driver circuit that counts the character write operations to the status displays 14,16 where each character is written thereby spelling out the encoded number message prompt. The output from the font counter and compare network U30 is used as the first half address to the font counter and direction counter selector U23 and as the second half address that is input to the font counter ROM U31. The font counter and compare network U30 output via /63 is also used as the input address to the status display control U33 that drives the character information to be scrolled onto the upper status display 14 and lower status display 16 via /67.

The character font output address from the font counter and compare network U30 via /63 is further compared against a fixed font character input number within this network via /64. When the count of write operations becomes greater than the maximum fixed number input via /64 (i.e. when a number greater than 19 is reached), a signal is sent from the font counter and compare network U30 via /65 to the logic control network U10 which sends a reset signal from the logic control network U10 to the font counter and compare network U30 via the control bus /31. This stops and resets the font counter within the network and starts the display of the next prompted message.

An audible tone generator U11 is utilized for the operator to provide a single audible beep tone to be produced via /39 to the buzzer element whenever the operator presses any page, function, direction or numeric input key. A signal is sent from the logic control network U10 via the control bus /31 and causes a single timing signal pulse out from the timing network U2 via /4 to pass through the audible tone generator U11 and out to the buzzer element via /39 which is connected to the positive side of the power source via /40.

While the hand held device 10 is in the page mode of operation and the operator has entered answers and pressed the answer key 26, the device will respond with a beeping signal if the page solution is correct. A correct solution is indicated by a continuous beeping tone that is generated from the audible tone generator U11 via /39 to the buzzer element. The beeping signal indicates the operator has solved the puzzle and has therefore, won the game. If any of the four mode keys: page 18, across 20, down 22 or puzzle 24 are pressed after the buzzing has started, a signal will be sent from the mode selection section via /41 to the logic control network U10 that will cause a reset signal to be sent to the control bus /31 and then to the audible tone generator U11. This disables the timing input signal from the timing network U2 via /4 to the audible tone generator U11 to turn off the beeping.

It is contemplated that the planar grid structure can also be used as a board game embodiment that includes a variety of game playing rules. It is also contemplated that the game may be fully utilized on the Internet, both in its planar grid embodiment and with the corresponding method.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as the invention is:

1. A digital crossword-style puzzle game device comprising:

a. an instruction memory, a logic control network, an EEPROM memory unit, a data comparator, at least one multi-character status display, a multi-character puzzle play screen matrix, user entry keys and a puzzle cartridge unit;

b. said instruction memory operative with said logic control network, said logic control network operative with the EEPROM memory unit to:

i. receive input from said user entry keys;

ii. display answer groups from which the user may select;

iii. display status messages concerning the status of the game on said at least one multi-character status display;

iv. display numeric data resulting from the users input on said multi-character puzzle play screen matrix;

v. control the flow of data between said puzzle cartridge unit and said EEPROM memory unit;

c. said multi-character puzzle play screen matrix having a combination of useable and unusable empty spaces oriented in a horizontal direction; and a combination of useable and unusable empty spaces oriented in a vertical direction; said useable spaces having a different indicia than said unusable spaces whereby the user can distinguish between said usable and said unusable spaces;

d. wherein said useable and unusable empty spaces forms a grid structure having a combination of horizontal, vertical, and diagonal rows of useable and unusable spaces and each row of said useable spaces in a continuous horizontal or vertical direction forms a clue placement position;

e. said puzzle cartridge unit having data that includes multiple groups of number sets, each number set includes the same number of digits as each corresponding said clue placement position wherein an individual number set within an answer group is selected by the user with said user entry keys to fill-in said horizontal and vertical clue placement positions and the quantity of said answer groups is equal to the quantity of said clue placement positions;

f. wherein when said user selects individual number sets within an answer group, said user simultaneously attempts to enter numbers that would result in the mathematical difference between any adjacent digits in either the diagonal direction, the horizontal direction or the vertical direction being greater than one; and g. said data comparator determines if the mathematical difference between adjacent numbers on any diagonal number string resulting from the number sets entered into said grid structure by the user is greater than one; and generates a signal that is used by said logic control network to generate a corresponding status message on said multi-character status display.

2. The digital crossword-style puzzle game device as claimed in claim 1 wherein said logic control network generates status messages in response to the user's input selected from a group consisting of: correct, incorrect and incomplete.

3. The digital crossword-style puzzle game device as claimed in claim 1 wherein said usable and unusable spaces are constructed of intelligent character liquid crystal display modules.

4. The digital crossword-style puzzle game device as claimed in claim 1 wherein each of said number sets in said answer groups contained in said puzzle cartridge unit does not contain any identical digits.

5. The digital crossword-style puzzle game device as claimed in claim 1 wherein the indicia of said useable spaces is white and the indicia of said unusable spaces is black.

6. The digital crossword-style puzzle game device as claimed in claim 1 wherein said number sets are comprised of at least three digits between 0 and 9.

7. A method of playing a mathematical number game on a planar grid structure having a combination of predefined useable and unusable empty spaces; wherein said useable spaces are indicated by indicia different from said unusable spaces; and wherein said grid structure forms horizontal, vertical, and diagonal rows of useable spaces; said continuous useable spaces in each horizontal and vertical direction form clue placement positions; wherein said method comprises the steps of:

a. selecting a number set from a provided number group;

b. positioning said selected number set in a desired clue placement position on said grid structure;

c. evaluating said selected number set in said desired clue placement position relative to said grid structure to ensure that the mathematical difference between any two adjacent digits simultaneously in any horizontal, vertical, and diagonal rows of useable spaces is greater than one; and d. repeating steps a through c until said selected number set passes the test set forth in step c.

8. The method of playing a mathematical number game as claimed in claim 7 wherein a player performs said method on a computer network.

9. The method of playing a mathematical number game as claimed in claim 7 including an additional step before step d of evaluating said selected number set relative to the entire grid structure to ensure that every two adjacent numbers in any continuous horizontal, vertical, or diagonal direction are different.

10. A crossword style mathematical game apparatus comprising:

a pre-defined grid having a combination of useable and unusable spaces; wherein said usable spaces are indicated by an indicia different from said unusable spaces, said useable and unusable empty spaces forms a grid structure having a combination of horizontal, vertical, and diagonal rows of useable and unusable spaces;

each of said horizontal rows and each of said vertical rows of usable spaces is a designated clue placement position;

a set of across answer groups and a set of down answer groups, each answer group comprising number sets from which a player may choose, is provided for each of said clue placement positions; each answer group comprises at least one correct answer set for each clue placement position that results in the mathematical difference between every two adjacent digits in any vertical, horizontal or diagonal direction in said grid structure becoming two or more.

11. The crossword style mathematical game apparatus as claimed in claim 10 wherein said number set that results in the mathematical difference between every two adjacent numbers in said grid structure becoming two or more also does not include any two identical numbers in said number set.

12. The crossword style mathematical game apparatus as claimed in claim 10 wherein said number set that results in the mathematical difference between every two adjacent numbers in said grid structure becoming two or more also does not include a leading zero in said number set.

13. The crossword style mathematical game apparatus as claimed in claim 10 wherein a first of said designated clue placement positions is located at the top, left side of said grid structure and each subsequent clue positions is designated consecutively to the right and then down.

14. The crossword style mathematical game apparatus as claimed in claim 10 wherein said clue placement positions are represented by numeric indicia, which correspond to a numeric indicia of said answer groups.

15. The crossword style mathematical game apparatus as claimed in claim 10 wherein said designated clue placement positions are represented by alphanumeric indicia that correspond to alphanumeric indicia of said answer groups.

16. The crossword style mathematical game apparatus as claimed in claim 10 wherein said predefined grid is posted for the player on a computer network.

17. The crossword style mathematical game apparatus as claimed in claim 10 wherein said number sets are comprised of at least three single digits between 0 and 9.

* * * * *